US012276076B1

(12) United States Patent
Li et al.

(10) Patent No.: US 12,276,076 B1
(45) Date of Patent: Apr. 15, 2025

(54) GREEN SEALING MATERIAL FOR KARST FLOWING WATER, AND PREPARATION METHOD AND USE THEREOF

(71) Applicant: Shandong University, Jinan (CN)

(72) Inventors: Liping Li, Jinan (CN); Jing Wang, Jinan (CN); Yijie Zhang, Jinan (CN); Shikui Jia, Handan (CN); Xingzhi Ba, Jinan (CN); Shuailong Jia, Handan (CN); Diyang Chen, Jinan (CN); Hao Jiang, Jinan (CN); Ruizhi Jia, Jinan (CN); Xiaobo Zhang, Jinan (CN); Xincan Lu, Jinan (CN)

(73) Assignee: Shandong University, Jinan (CN)

( * ) Notice: Subject to any disclaimer, the term of this patent is extended or adjusted under 35 U.S.C. 154(b) by 0 days.

(21) Appl. No.: 18/960,181

(22) Filed: Nov. 26, 2024

(30) Foreign Application Priority Data

Nov. 27, 2023 (CN) ..... 202311591450.8

(51) Int. Cl.
*E02D 3/12* (2006.01)

(52) U.S. Cl.
CPC ..... *E02D 3/12* (2013.01)

(58) Field of Classification Search
CPC ..... E02D 3/12; E02D 19/06; C09K 17/02; C09K 17/10; C04B 7/32; C04B 14/04; C04B 22/062; C04B 28/34
See application file for complete search history.

(56) References Cited

U.S. PATENT DOCUMENTS

| | | | | |
|---|---|---|---|---|
| 11,214,938 | B2 * | 1/2022 | Tang | E02D 5/36 |
| 11,905,352 | B2 * | 2/2024 | Li | C08F 220/06 |
| 2008/0260473 | A1 * | 10/2008 | Smith | E02D 5/18 405/267 |
| 2021/0292987 | A1 * | 9/2021 | Tang | E21B 7/28 |

FOREIGN PATENT DOCUMENTS

| | | | |
|---|---|---|---|
| CN | 104556918 | A | 4/2015 |
| CN | 112194455 | A | 1/2021 |

OTHER PUBLICATIONS

CNIPA, Office Action, Application No. 202311591450.8, Jun. 3, 2024.

* cited by examiner

*Primary Examiner* — Benjamin F Fiorello
(74) *Attorney, Agent, or Firm* — WCF IP

(57) ABSTRACT

Provided are a green sealing material for karst flowing water, and a preparation method and use thereof. The green sealing material includes a component A and a component B, with a volume ratio of the component A to the component B being in a range of 4:1 to 5:1; where the component A includes in parts by weight: 40 parts to 50 parts of a sulphoaluminate cement, 10 parts to 15 parts of a light-burned magnesium oxide, 1 part to 4 parts of boric acid, and 40 parts to 50 parts of water; and the component B includes in parts by weight: 0.2 parts to 0.4 parts of hydroxypropyl methylcellulose, 0.1 parts to 0.5 parts of polyacrylamide, 15 parts to 30 parts of potassium dihydrogen phosphate, 0.2 parts to 0.4 parts of triethanolamine, 0.5 parts to 1 part of lithium carbonate, and 80 parts to 100 parts of water.

10 Claims, No Drawings

GREEN SEALING MATERIAL FOR KARST FLOWING WATER, AND PREPARATION METHOD AND USE THEREOF

CROSS REFERENCE TO RELATED APPLICATION

This patent application claims the benefit and priority of Chinese Patent Application No. 202311591450.8 filed with the China National Intellectual Property Administration on Nov. 27, 2023, the disclosure of which is incorporated by reference herein in its entirety as part of the present application.

TECHNICAL FIELD

The present disclosure belongs to the field of underground engineering, and particularly relates to a green sealing material for karst flowing water, and a preparation method and use thereof.

BACKGROUND

Information disclosed in this background section is only intended to increase understanding for the general background of the present disclosure, and is not necessarily considered as an admission or any form of suggestion that this information constitutes prior art well known to those skilled in the art.

Many cities are located in karst areas. Therefore, during the construction of urban underground engineering in karst areas, water-rich cracks, pipelines, caves and other disaster sources are easily exposed, leading to sudden gushing water, which often exhibits characteristics such as large water volume and high flow rate. Moreover, the environmental ecology of cities is fragile. During the control of sudden gushing water, the uncontrollable diffusion distance for sealing materials and the non-environmentally friendly slurry materials could easily trigger groundwater pollution, seriously threatening residents' water safety. Therefore, it is urgent to develop a green and pollution-free sealing material for karst flowing water with resistance to dispersal by flowing water and controllable diffusion distance to meet the demands for sealing sudden gushing water in underground engineering in cities of karst areas.

SUMMARY

To solve the shortcomings in the prior art, an object of the present disclosure is to provide a green sealing material for karst flowing water, and a preparation method and use thereof. The sealing material in the present disclosure could achieve green targeted sealing for the karst flowing water in urban environments, thereby achieving low-influence control to karst gushing water in urban environments.

To achieve the above object, the present disclosure provides the following technical solution:

In the first aspect, the present disclosure provides a green sealing material for karst flowing water, including/consisting of a component A and a component B, with a volume ratio of the component A to the component B being in a range of 4:1 to 5:1; wherein the component A includes in parts by weight: 40 parts to 50 parts of a sulphoaluminate cement, 10 parts to 15 parts of a light-burned magnesium oxide, 1 part to 4 parts of boric acid, and 40 parts to 50 parts of water; and the component B includes in parts by weight: 0.2 parts to 0.4 parts of hydroxypropyl methylcellulose, 0.1 parts to 0.5 parts of polyacrylamide, 15 parts to 30 parts of potassium dihydrogen phosphate, 0.2 parts to 0.4 parts of triethanolamine, 0.5 parts to 1 part of lithium carbonate, and 80 parts to 100 parts of water.

The green sealing material for karst flowing water of the present disclosure is green and nontoxic, and does not pollute urban groundwater. The green sealing material is highly resistant to scour. In some embodiments, the slurry has a retention rate of 95% in water flowing at a speed of 1 m/s. The green sealing material achieves ultra-short initial setting time, shortening the initial setting time to 30 s, with the slurry becoming paste-like after initial setting, and the final setting time is controllable, balancing resistance to flowing water and long-distance grouting, which makes it very suitable for sealing karst flowing water with excellent sealing effect.

In some embodiments of the present disclosure, light-burned magnesium oxide and potassium dihydrogen phosphate quickly react to form struvite, thus rapidly turning the slurry into a Bingham-like fluid, thus making the slurry have certain resistance to scour, and the reaction forms a complex with sulphoaluminate cement, thereby enhancing the strength of the whole system. Boric acid reacts with potassium dihydrogen phosphate to reduce the reaction rate between potassium dihydrogen phosphate and light-burned magnesium oxide. By adding boric acid, the initial setting time of the material is effectively reduced, and the initial and final setting time of the slurry is adjusted by the amount of the boric acid added. Hydroxypropyl methylcellulose improves the stability of solution B, increases the viscosity of the slurry and enhances the resistance of the slurry to scour. Polyacrylamide has lubrication function, improves the lubricity of the slurry and has flocculation function, achieves the initial setting of the slurry in a short time, ensuring the resistance of the slurry to scour. Triethanolamine and lithium carbonate promote the setting speed of sulphoaluminate cement, thus facilitating the rapid setting of the slurry.

In some embodiments of the present disclosure, the sulphoaluminate cement has a specific surface area of 400 $m^2/kg$ to 600 $m^2/kg$, and the sulphoaluminate cement has a setting time of 5 min to 20 min at a water-to-cement ratio of 0.5.

In some embodiments of the present disclosure, the sulphoaluminate cement includes: 6 wt % to 12 wt % of $SiO_2$, 25 wt % to 35 wt % of $Al_2O_3$, 40 wt % to 45 wt % of CaO, and 12 wt % to 15 wt % of $SO_3$.

In some embodiments of the present disclosure, the light-burned magnesium oxide has a specific surface area of 300 $m^2/kg$ to 400 $m^2/kg$, and the light-burned magnesium oxide is obtained by calcining magnesium oxide at a calcination temperature of 1000° C. to 1200° C. The light-burned magnesium oxide and the dipotassium hydrogen phosphate quickly react to increase the viscosity of the slurry, thereby improving the resistance of the slurry to scour.

In some embodiments of the present disclosure, the boric acid is of analytical purity. The Boric acid is mainly used to inhibit the reaction between light-burned magnesium oxide and dipotassium hydrogen phosphate.

In some embodiments of the present disclosure, the hydroxypropyl methylcellulose has a number average molecular weight of 100,000 to 200,000.

In some embodiments of the present disclosure, the polyacrylamide has a number average molecular weight of 10 million to 18 million.

In some embodiments of the present disclosure, the potassium dihydrogen phosphate is of analytical purity.

In some embodiments of the disclosure, the triethanolamine is of analytical purity.

In some embodiments of the disclosure, the lithium carbonate is of analytical purity.

In the second aspect, the present disclosure provides a method for preparing the green sealing material for karst flowing water as described in the first aspect above, including:

mixing the sulfoaluminate cement, the light-burned magnesium oxide, the boric acid, and the water to obtain the component A;

mixing the hydroxypropyl methylcellulose, the polyacrylamide, the potassium dihydrogen phosphate, the triethanolamine, the lithium carbonate, and the water to obtain the component B; and mixing the component A and the component B according to the volume ratio of 4:1 to 5:1 to obtain the green sealing material for karst flowing water. If the amount of the component B is high, it would prevent the slurry from final setting.

In the third aspect, the present disclosure provides use of the green sealing material for karst flowing water as described in the first aspect above in the field of sudden gushing water control.

In the third aspect, the present disclosure provides a method for controlling sudden gushing water, including:

injecting a slurry by pressure grouting into a water outlet and surroundings thereof until there is no water seepage or water gushing within three minutes after sealing the water outlet;

wherein the slurry injected is the green sealing material for karst flowing water as described in the first aspect above.

Some embodiments of the present disclosure have the following beneficial effects:

The present disclosure provides a green sealing material for karst flowing water, including a component A and a component B, with a volume ratio of the component A to the component B being 4:1 to 5:1; wherein the component A includes in parts by weight: 40 parts to 50 parts of a sulphoaluminate cement, 10 parts to 15 parts of a light-burned magnesium oxide, 1 part to 4 parts of boric acid, and 40 parts to 50 parts of water; and the component B includes in parts by weight: 0.2 parts to 0.4 part of hydroxypropyl methylcellulose, 0.1 parts to 0.5 parts of polyacrylamide, 15 parts to 30 parts of potassium dihydrogen phosphate, 0.2 parts to 0.4 parts of triethanolamine, 0.5 parts to 1 part of lithium carbonate, and 80 parts to 100 parts of water. Compared with the prior art, the green sealing material for karst flowing water of the present disclosure adopts components with specific contents, and the components have better interaction with each other, so that the sealing material shows the advantages of high resistance to scour, ultra-short initial setting time, controllable final setting time, and the like, balancing resistance to flowing water and long-distance grouting. Further, all materials selected in embodiments are non-toxic, and no toxin is generated in the reaction process, and thus the green sealing material also is environmentally friendly and green, and effectively solves the problems of poor resistance to dispersal in flowing water, uncontrollable diffusion distance, and groundwater pollution caused by non-environmentally friendly slurry in traditional sealing materials for flowing water, making it meet the demands for sealing sudden gushing water in underground engineering in cities of karst areas. Experimental results show that the initial setting time of the green sealing material for karst flowing water in some embodiments of the present disclosure is shortened to 30 s, and the final setting time is 30 min. The slurry has a retention rate of 95% in water flowing at a speed of 1 m/s. The 3-day compressive strength reaches 7 MPa and the 28-day compressive strength reaches 11.2 MPa.

In addition, the method in some embodiments of the present disclosure is simple, the raw materials used are green and environment-friendly, and the conditions are mild, greatly meeting the demands for sealing sudden gushing water in underground engineering in cities of karst areas.

DETAILED DESCRIPTION OF THE EMBODIMENTS

In order to enable those skilled in the art understand the technical solutions of the present disclosure more clearly, the technical solutions of the present disclosure will be described in detail with specific examples.

Example 1

A method for preparing a green sealing material for karst flowing water was performed as follows:

The green sealing material for karst flowing water was composed of a component A and a component B. 50 parts of a sulphoaluminate cement, 10 parts of a light-burned magnesium oxide, 2 parts of boric acid, and 40 parts of water were mixed according to mass ratio to obtain a slurry of the component A; and 0.3 parts of hydroxypropyl methylcellulose, 0.2 parts of polyacrylamide, 30 parts of potassium dihydrogen phosphate, 0.3 parts of triethanolamine, 0.8 parts of lithium carbonate, and 100 parts of water were mixed according to mass ratio to obtain a slurry of the component B.

The sulphoaluminate cement (having a specific surface area of 500 $m^2$/kg) had a setting time of 10 min at a water-to-cement ratio of 0.5. The light-burned magnesium oxide had a specific surface area of 300 $m^2$/kg and was obtained by calcining magnesium oxide at a calcination temperature of 1100° C. The hydroxypropyl methylcellulose had a number average molecular weight of 200,000. The polyacrylamide had a number average molecular weight of 15 million.

The slurry of the component A and the slurry of the component B were mixed according to a volume ratio of 5:1 to obtain the green sealing material for karst flowing water.

After testing, the green sealing material for karst flowing water prepared according to the above ratio has an initial setting time of 30 s and a final setting time of 30 min. The slurry has a retention rate of 95% in water flowing at a speed of 1 m/s. The 3-day compressive strength is 7 MPa and the 28-day compressive strength is 11.2 MPa.

In this example, the green sealing material for karst flowing water and the preparation method thereof are green, non-toxic, and highly resistant to scour. The green sealing material achieves ultra-short initial setting, with the slurry becoming paste-like after initial setting, and the final setting time is controllable, balancing resistance to flowing water and long-distance grouting.

Example 2

In this example, a method for preparing a green sealing material for karst flowing water was performed according to the method as described in Example 1, except that the light-burned magnesium oxide had a specific surface area of 400 $m^2$/kg.

After testing, the green sealing material prepared according to the above ratio has a initial setting time of 30 s, and the viscosity of the slurry changes suddenly after 4 min, and the green sealing material has a final setting time of 25 min. The slurry has a retention rate of 97% in water flowing at a speed of 1 m/s. The 3-day compressive strength is 5.7 MPa and the 28-day compressive strength is 10.1 MPa.

Example 3

In this example, a method for preparing a green sealing material for karst flowing water was performed according to the method as described in Example 1, except that the hydroxypropyl methylcellulose had a number average molecular weight of 100,000.

After testing, the green sealing material for karst flowing water prepared according to the above ratio has an initial setting time of 27 s and a final setting time of 25 min. The slurry has a retention rate of 85% in water flowing at a speed of 1 m/s. The 3-day compressive strength is 7.2 MPa and the 28-day compressive strength is 11.3 MPa.

Example 4

In this example, a method for preparing a green sealing material for karst flowing water was performed according to the method as described in Example 1, except that the polyacrylamide had a number average molecular weight of 10 million.

After testing, the green sealing material for karst flowing water prepared according to the above ratio has an initial setting time of 120 s and a final setting time of 20 min. The slurry has a retention rate of 65% in water flowing at a speed of 1 m/s. The 3-day compressive strength is 8.1 MPa and the 28-day compressive strength is 12.5 MPa.

Example 5

In this example, a method for preparing a green sealing material for karst flowing water was performed according to the method as described in Example 1, except that the slurry of the component A and the slurry of the component B were mixed according to a volume ratio of 4:1.

After testing, the green sealing material for karst flowing water prepared according to the above ratio has an initial setting time of 40 s and a final setting time of 45 min. The slurry has a retention rate of 90% in water flowing at a speed of 1 m/s. The 3-day compressive strength is 6.4 MPa and the 28-day compressive strength is 9.6 MPa.

Example 6

A method for preparing a green sealing material for karst flowing water was performed as follows:

The green sealing material for karst flowing water was composed of a component A and a component B. 40 parts of a sulphoaluminate cement, 10 parts of a light-burned magnesium oxide, 1 part of boric acid, and 40 parts of water were mixed according to mass ratio to obtain a slurry of the component A; and 0.2 parts of hydroxypropyl methylcellulose, 0.1 parts of polyacrylamide, 15 parts of potassium dihydrogen phosphate, 0.2 parts of triethanolamine, 0.5 parts of lithium carbonate, and 80 parts of water were mixed according to mass ratio to obtain a slurry of the component B.

The sulphoaluminate cement had a setting time of 5 min at a water-to-cement ratio of 0.5. The light-burned magnesium oxide had a specific surface area of 300 $m^2$/kg and was obtained by calcining magnesium oxide at a calcination temperature of 1100° C. The hydroxypropyl methylcellulose had a number average molecular weight of 100,000. The polyacrylamide had a number average molecular weight of 10 million.

The slurry of the component A and the slurry of the component B were mixed according to a volume ratio of 4:1 to obtain the green sealing material for karst flowing water.

After testing, the green sealing material for karst flowing water prepared according to the above ratio has an initial setting time of 40 s and a final setting time of 25 min. The slurry has a retention rate of 45% in water flowing at a speed of 1 m/s. The 3-day compressive strength is 5.5 MPa and the 28-day compressive strength is 9.3 MPa.

Example 7

A method for preparing a green sealing material for karst flowing water was performed as follows:

The green sealing material for karst flowing water was composed of a component A and a component B. 50 parts of a sulphoaluminate cement, 15 parts of a light-burned magnesium oxide, 4 parts of boric acid, and 50 parts of water were mixed according to mass ratio to obtain a slurry of the component A; and 0.4 parts of hydroxypropyl methylcellulose, 0.5 parts of polyacrylamide, 30 parts of potassium dihydrogen phosphate, 0.4 parts of triethanolamine, 1 part of lithium carbonate, and 100 parts of water were mixed according to mass ratio to obtain a slurry of the component B.

The sulphoaluminate cement had a setting time of 20 min at a water-to-cement ratio of 0.5. The light-burned magnesium oxide had a specific surface area of 400 $m^2$/kg and was obtained by calcining magnesium oxide at a calcination temperature of 1100° C. The hydroxypropyl methylcellulose had a number average molecular weight of 200,000. The polyacrylamide had a number average molecular weight of 18 million.

The slurry of the component A and the slurry of the component B were mixed according to a volume ratio of 5:1 to obtain the green sealing material for karst flowing water.

After testing, the green sealing material for karst flowing water prepared according to the above ratio has an initial setting time of 30 s and a final setting time of 60 min. The slurry has a retention rate of 80% in water flowing at a speed of 1 m/s. The 3-day compressive strength is 7.3 MPa and the 28-day compressive strength is 12.1 MPa.

Comparative Example 1

A method for preparing a green sealing material for karst flowing water was performed as follows:

The green sealing material for karst flowing water was composed of a component A and a component B. 50 parts of a sulphoaluminate cement, 2 parts of boric acid, and 40 parts of water were mixed according to mass ratio to obtain a slurry of the component A; and 0.3 parts of hydroxypropyl methylcellulose, 0.2 parts of polyacrylamide, 0.3 parts of triethanolamine, 0.8 parts of lithium carbonate, and 100 parts of water were mixed according to mass ratio to obtain a slurry of the component B.

The sulphoaluminate cement had a setting time of 10 min at a water-to-cement ratio of 0.5. The hydroxypropyl methylcellulose had a number average molecular weight of 200,000. The polyacrylamide had a number average molecular weight of 15 million.

The slurry of the component A and the slurry of the component B were mixed according to a volume ratio of 5:1 to obtain the green sealing material for karst flowing water.

After testing, the green sealing material for karst dynamic water prepared according to the above ratio has an initial setting time of 30 s and a final setting time of 50 min. The slurry has a retention rate of 80% in water flowing at a speed of 1 m/s. The 3-day compressive strength is 5.4 MPa and the 28-day compressive strength is 9.7 MPa.

Light-burned magnesium oxide and potassium dihydrogen phosphate could promote the initial setting of materials, and generate heat to accelerate the final setting of slurry. In Comparative Example 1, light-burned magnesium oxide and potassium dihydrogen phosphate were not added, and the final setting time, retention rate and compressive strength are therefore reduced.

Comparative Example 2

A method for preparing a green sealing material for karst flowing water was performed as follows:

The green sealing material for karst flowing water was composed of a component A and a component B. 50 parts of a sulphoaluminate cement, 10 parts of a light-burned magnesium oxide, 2 parts of boric acid, and 40 parts of water were mixed according to mass ratio to obtain a slurry of the component A; and 0.3 parts of hydroxypropyl methylcellulose, 0.2 parts of polyacrylamide, 30 parts of potassium dihydrogen phosphate, 0.3 parts of triethanolamine, 0.8 parts of lithium carbonate, and 100 parts of water were mixed according to mass ratio to obtain a slurry of the component B.

The sulphoaluminate cement had a setting time of 10 min at a water-to-cement ratio of 0.5. The light-burned magnesium oxide had a specific surface area of 300 $m^2$/kg and was obtained by calcining magnesium oxide at a calcination temperature of 1100° C. The hydroxypropyl methylcellulose had a number average molecular weight of 100,000. The polyacrylamide had a number average molecular weight of 10 million.

The slurry of the component A and the slurry of the component B were mixed according to a volume ratio of 5:1 to obtain the green sealing material for karst flowing water.

After testing, the green sealing material for karst dynamic water prepared according to the above ratio has an initial setting time of 20 min and a final setting time of 30 min. The slurry has a retention rate of 50% in water flowing at a speed of 1 m/s. The 3-day compressive strength is 7.5 MPa and the 28-day compressive strength is 12.4 MPa.

Polyacrylamide had a number average molecular weight of 10 million, so the slurry could not be agglomerated, and the resistance to scour is obviously reduced. In addition, hydroxypropyl methylcellulose could form a three-dimensional network structure in the slurry, improving the resistance of the slurry to scour, but due to its low molecular weight and short molecular chain, the network structure is not firmly connected, easily leading to the decrease in the retention rate of the slurry.

The above description is merely the preferred embodiments of the present disclosure, and it is not intended to limit the present disclosure. For those skilled in the art, various modifications and changes could be made to the present disclosure. Any modifications, equivalent substitutions, improvements, etc. made within the spirit and principle of the present disclosure should be deemed as falling within the scope of the present disclosure.

What is claimed is:

1. A green sealing material for karst flowing water, comprising a component A and a component B, with a volume ratio of the component A to the component B being in a range of 4:1 to 5:1; wherein the component A comprises in parts by weight: 40 parts to 50 parts of a sulphoaluminate cement, 10 parts to 15 parts of a light-burned magnesium oxide, 1 part to 4 parts of boric acid, and 40 parts to 50 parts of water; and the component B comprises in parts by weight: 0.2 parts to 0.4 parts of hydroxypropyl methylcellulose, 0.1 parts to 0.5 parts of polyacrylamide, 15 parts to 30 parts of potassium dihydrogen phosphate, 0.2 parts to 0.4 parts of triethanolamine, 0.5 parts to 1 part of lithium carbonate, and 80 parts to 100 parts of water; and the hydroxypropyl methylcellulose has a molecular weight of 200,000;

the polyacrylamide has a molecular weight of 15 million;

the green sealing material for karst flowing water is prepared by a method, comprising:

mixing the sulphoaluminate cement, the light-burned magnesium oxide, the boric acid, and the water to obtain the component A;

mixing the hydroxypropyl methylcellulose, the polyacrylamide, the potassium dihydrogen phosphate, the triethanolamine, the lithium carbonate, and the water to obtain the component B; and mixing the component A and the component B according to the volume ratio of 4:1 to 5:1 to obtain the green sealing material for karst flowing water.

2. The green sealing material for karst flowing water of claim 1, wherein the sulphoaluminate cement has a specific surface area of 400 $m^2$/kg to 600 $m^2$/kg, and the sulphoaluminate cement has a setting time of 5 min to 20 min at a water-to-cement ratio of 0.5.

3. The green sealing material for karst flowing water of claim 1, wherein the light-burned magnesium oxide has a specific surface area of 300 $m^2$/kg to 400 $m^2$/kg, and the light-burned magnesium oxide is obtained by calcining magnesium oxide at a calcination temperature of 1000° C. to 1200° C.

4. The green sealing material for karst flowing water of claim 1, wherein the boric acid is of analytical purity.

5. The green sealing material for karst flowing water of claim 1, wherein the potassium dihydrogen phosphate is of analytical purity; or the triethanolamine is of analytical purity; or the lithium carbonate is of analytical purity.

6. A method for controlling sudden gushing water, comprising:

injecting a slurry by pressure grouting into a water outlet and surroundings thereof until there is no water seepage or water gushing within three minutes after sealing the water outlet;

wherein the slurry injected is the green sealing material for karst flowing water according to claim 1.

7. The method for controlling the sudden gushing water of claim 6, wherein the sulphoaluminate cement has a specific surface area of 400 $m^2$/kg to 600 $m^2$/kg, and the sulphoaluminate cement has a setting time of 5 min to 20 min at a water-to-cement ratio of 0.5.

8. The method for controlling the sudden gushing water of claim 6, wherein the light-burned magnesium oxide has a specific surface area of 300 $m^2$/kg to 400 $m^2$/kg, and the light-burned magnesium oxide is obtained by calcining magnesium oxide at a calcination temperature of 1000° C. to 1200° C.

9. The method for controlling the sudden gushing water of claim 6, wherein the boric acid is of analytical purity.

10. The method for controlling the sudden gushing water of claim 6, wherein the potassium dihydrogen phosphate is of analytical purity; or the triethanolamine is of analytical purity; or the lithium carbonate is of analytical purity.

* * * * *